US011056069B2

(12) United States Patent
Huang et al.

(10) Patent No.: US 11,056,069 B2
(45) Date of Patent: Jul. 6, 2021

(54) NEAR-EYE LIQUID CRYSTAL DISPLAY WITH OVERLAPPING LIQUID CRYSTAL SETTLING AND BACKLIGHT ACTIVATION TIMING SCHEME

(71) Applicant: Google LLC, Mountain View, CA (US)

(72) Inventors: Jonathan Huang, Sunnyvale, CA (US); Gaurav Shah, Los Altos, CA (US)

(73) Assignee: Google LLC, Mountain View, CA (US)

( * ) Notice: Subject to any disclaimer, the term of this patent is extended or adjusted under 35 U.S.C. 154(b) by 72 days.

(21) Appl. No.: 15/953,887

(22) Filed: Apr. 16, 2018

(65) Prior Publication Data

US 2019/0318701 A1 Oct. 17, 2019

(51) Int. Cl.
*G09G 3/36* (2006.01)
*G09G 3/34* (2006.01)

(52) U.S. Cl.
CPC ..... *G09G 3/3648* (2013.01); *G09G 3/3406* (2013.01); *G09G 2310/06* (2013.01); *G09G 2310/08* (2013.01); *G09G 2320/0261* (2013.01); *G09G 2320/0626* (2013.01)

(58) Field of Classification Search
CPC ..... G09G 3/3648; G09G 3/3406; G09G 2320/0626; G09G 2310/06; G09G 2310/08; G09G 2320/0261; G09G 2310/0232; G09G 2310/0237; G09G 2340/0492; G09G 3/001
See application file for complete search history.

(56) References Cited

U.S. PATENT DOCUMENTS 8,482,698 B2 7/2013 Atkins
8,773,336 B2 7/2014 Knapp
8,994,640 B2 3/2015 Slavenburg et al.
10,209,523 B1 * 2/2019 Zhang ..... G02B 27/0172
(Continued)

FOREIGN PATENT DOCUMENTS

EP 2109094 A1 10/2000

OTHER PUBLICATIONS

International Search Report and Written Opinion dated May 21, 2019 for corresponding International Application No. PCT/US2019/023116, 13 pages.

(Continued)

*Primary Examiner* — Temesghen Ghebretinsae
*Assistant Examiner* — Ivelisse Martinez Quiles

(57) ABSTRACT

A method for driving a liquid crystal display (LCD) panel includes sequentially buffering each row of pixel data of a first display image in a corresponding pixel row of the LCD panel. The method also includes activating a backlight of the LCD panel after the last row of pixel data of the first display image has been buffered at the last pixel row of the LCD panel but before liquid crystal settling of the last pixel row of the LCD panel has completed. The method also may include initiating sequential buffering of each row of pixel data of a second display image in a corresponding pixel row of the LCD panel prior to the liquid crystal settling of the last pixel row of the LCD panel completing, wherein activating the backlight of the LCD panel comprises activating the backlight while at least one pixel row of the LCD panel buffers a corresponding row of pixel data from the second display image and other pixel rows of the LCD panel buffer corresponding rows of pixel data from the first display image.

19 Claims, 3 Drawing Sheets

(56) References Cited

U.S. PATENT DOCUMENTS

| | | | | |
|---|---|---|---|---|
| 2007/0132709 | A1* | 6/2007 | Kawaguchi | G09G 3/3406 345/102 |
| 2016/0307482 | A1* | 10/2016 | Huang | G09G 3/002 |
| 2017/0287408 | A1 | 10/2017 | Shi et al. | |
| 2017/0308161 | A1* | 10/2017 | Richards | G06F 3/011 |
| 2017/0309245 | A1* | 10/2017 | Richards | G09G 3/3688 |
| 2018/0090078 | A1* | 3/2018 | Chang | G09G 3/3406 |
| 2018/0197482 | A1* | 7/2018 | Choi | G09G 3/3266 |
| 2020/0005717 | A1* | 1/2020 | Masuda | G09G 3/36 |

OTHER PUBLICATIONS

"Motion Blur Reduction (ULMB, LightBoost, etc.)" <https://www.blurbusters.com/faq/motion-blur-reduction/> Accessed Apr. 24, 2018, 10 pages.

International Preliminary Report on Patentability dated Oct. 29, 2020 for International Application No. PCT/US2019/023116, 8 pages.

* cited by examiner

NEAR-EYE LIQUID CRYSTAL DISPLAY WITH OVERLAPPING LIQUID CRYSTAL SETTLING AND BACKLIGHT ACTIVATION TIMING SCHEME

BACKGROUND

Liquid crystal display (LCD) panels frequently are used in near-eye display systems, such as virtual reality (VR) or augmented reality (AR) head-mounted display (HMD) devices. However, the time needed to address every row in the LCD panel, coupled with the relatively long settling time of the liquid crystals implemented in the LCD panel (that is, the "LC settling time" or "LC settling period"), can limit the maximum frame rate implemented in a conventional LCD panel. Moreover, many near-eye display systems utilize a single LCD panel for both eyes, which can lead to problems with motion blur, especially at higher refresh rates. Conventional approaches to reducing motion blur typically incorporate specialized backlighting in order to illuminate the LCD panel with low persistence. However, given the frame rate limitations of conventional LCD panel driving techniques, the impact of specialized backlighting on reducing motion blur is limited.

BRIEF DESCRIPTION OF THE DRAWINGS

The present disclosure may be better understood, and its numerous features and advantages made apparent to those skilled in the art by referencing the accompanying drawings. The use of the same reference symbols in different drawings indicates similar or identical items.

DETAILED DESCRIPTION

Figure 1:
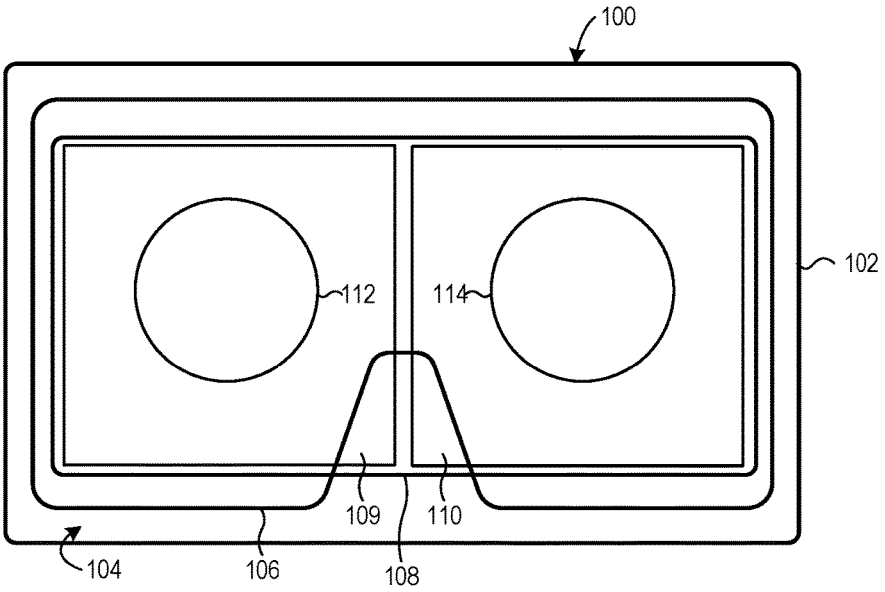
FIG. 1 is a diagram illustrating a rear view of a near-eye display device implementing overlapping image addressing and backlight timing in accordance with at least one embodiment of the present disclosure.

Head-mounted display (HMD) devices and other near-eye displays often utilize LCD panels due to their ubiquity and relative low cost. However, the frame period (which is inversely proportional to the frame rate) in a conventionally-timed LCD panel is relatively long due to the need to wait for the liquid crystals of the LCD panel to settle to their new states reflective of the input pixel data for a new display image before activating the backlighting used to display the display image. As such, conventionally-timed LCD panels often act as a bottleneck for virtual reality (VR) and augmented reality (AR) applications, which typically require high frame rates in order to provide acceptable experiences to users.

FIGS. 1-7 illustrate example systems and techniques employing overlapping timing schemes for an LCD panel employed in an HMD device or other near-eye display device so as to generate, transmit, and display images at a frame rate greater than that provided through conventional LCD panel timing for the same LCD panel addressing, backlight, and LC settling time parameters. For each display image to be displayed, the LCD panel is "addressed" with the pixel data for the display image; that is, the LCD panel sequentially buffers the pixel data for a display image on a row-by-row basis into the corresponding pixel rows of an array of liquid-crystal (LC)-based pixels. However, rather than waiting for the liquid crystals of the last pixel row to settle into their states corresponding to the pixel values in the last row (that is, the LC settling to complete) before activating the backlight to illuminate the display image as per conventional timing procedures, in at least one embodiment the timing of the LCD panel is configured so as to activate the backlight before the liquid crystals of the last pixel row settle, and then initiating the display of the display image sooner after the addressing of the pixel data into the array of LC-based pixels than in conventional LCD panel timing configurations. As a result, the frame period of each display image is shortened, and thus providing for an increased frame rate. Moreover, in some embodiments, the frame display period is further reduced, and thus the frame rate further increased, by configuring the timing of the LCD panel such that sequential buffering of each row of pixel data of the next display image is initiated prior to the LC settling completing for the last pixel row of the LCD panel for the previous image, rather than waiting for the liquid crystals of one or more of the last rows to settle and the backlighting to complete for a previous display image before starting the addressing of the next display image as required by conventional LCD panel timing configurations.

As described below, a timing scheme in which backlighting is activated before liquid crystal settling has completed for all of the pixel rows of the LCD panel can introduce "corruption" in the last one or more pixel rows of the LCD panel as the liquid crystals of those pixel rows may not be in the appropriate states for the corresponding pixel values. Similarly, initiating addressing of the first one or more rows of pixels of the next display image before the backlight has been activated for the previous display image can introduce "corruption" in the first one or more pixel rows of the LCD panel as these pixel rows contain pixel data for the next display image while the remaining pixel rows contain pixel data from the previous display image, and thus the liquid crystals for these first one or more pixel rows may be in an indeterminate state when the backlight is activated for display of the previous display image. However, when implemented in an HMD device or other near-eye display system, the LCD panel typically is arranged in a "landscape" orientation such that the top and bottom pixel rows of the LCD panel become the most peripheral pixel "columns" of the display relative to the user's perspective (that is, the user perceives the "top" and "bottom" of the LCD panel as the lateral edges of the display). Thus, the pixel corruption introduced by the overlapping addressing/backlighting timing techniques described herein appear at the lateral edges of the field of view (FOV) of the user where the user is less sensitive to visual aberrations. As such, the overlapping addressing/backlighting timing techniques described herein facilitate increased frame rates in LCD panel implementations, with the commensurate reduction in motion blur, at the cost of slight pixel corruption at the periphery of the user's FOV that typically will go unnoticed by the user. Moreover, such pixel corruption can be mitigated by configuring the optics of the near-eye display device to occlude or defocus the peripheral pixels, and thus preventing the pixel corruption from being observable by the user.

Turning now to FIG. 1, an example near-eye display device 100 configured to implement overlapping addressing/backlight timing scheme is disclosed in accordance with some embodiments. The near-eye display device 100 is illustrated in the example form of an HMD device, and thus is also referred to herein as "HMD device 100". The HMD device 100 is mounted to the head of the user through the use of an apparatus strapped to, or otherwise mounted on, the user's head such that the HMD device 100 is fixedly positioned in proximity to the user's face and thus moves with the user's movements. However, in some circumstances a user may hold a tablet computer or other hand-held device up to the user's face and constrain the movement of the hand-held device such that the orientation of the hand-held device to the user's head is relatively fixed even as the user's head moves. In such instances, a hand-held device operated in this manner also may be considered an implementation of the HMD device 100 even though it is not "mounted" via a physical attachment to the user's head.

The HMD device 100 comprises a housing 102 having a surface 104, and a face gasket 106 and set of straps or a harness (omitted from FIG. 1 for clarity) to mount the housing 102 on the user's head so that the user faces the surface 104 of the housing 102. The HMD device 100 further includes an LCD panel 108 arranged in a landscape orientation, such that the top and bottom pixel rows of the LCD panel appear as the left-most and right-most (or right-most and left-most) pixel "columns" from the perspective of the user when the HMD device 100 is mounted on the user's head. In the depicted embodiment, the HMD device 100 is a binocular HMD and thus the LCD panel 108 is arranged with a left-eye display region 109 and a right-eye display region 110; that is, the LCD panel 108 is logically divided into left and right "halves." The housing 102 further includes an eyepiece lens 112 aligned with the left-eye display region 109 and an eyepiece lens 114 aligned with the right-eye display region 110.

Figure 2:
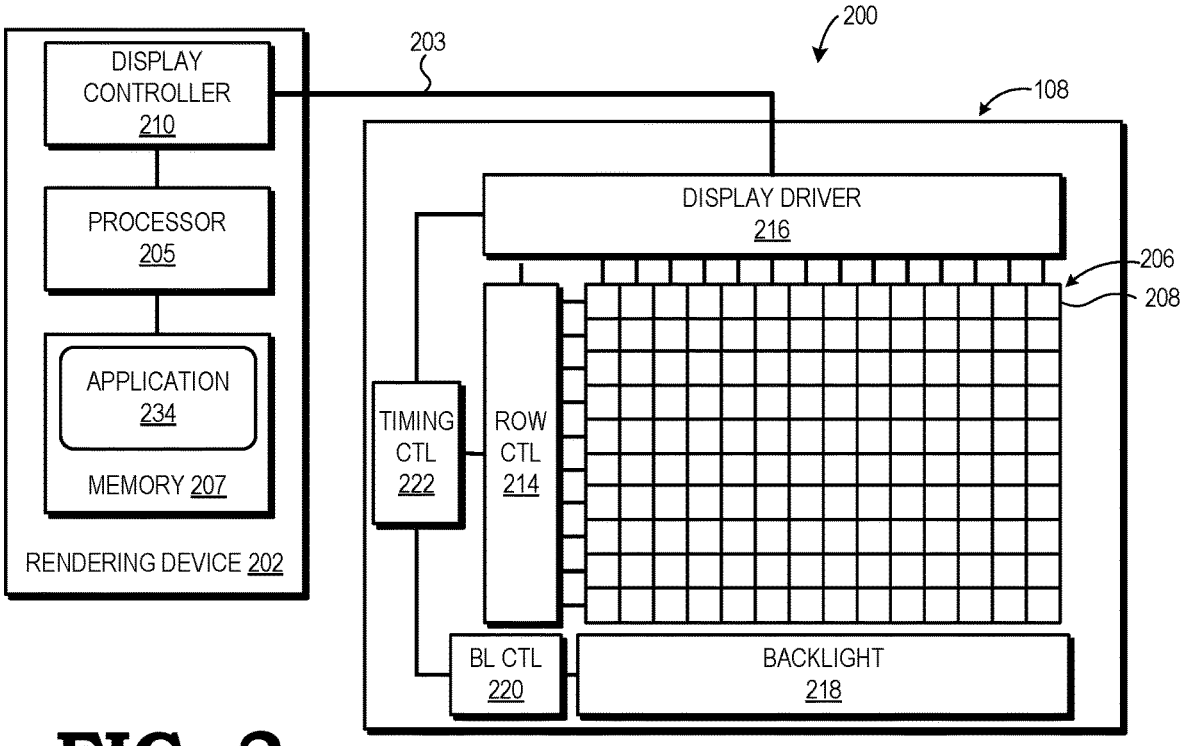
FIG. 2 is a block diagram of a display system utilizing the near-eye display device of FIG. 1 in accordance with some embodiments.

FIG. 2 illustrates a display system 200 implemented in whole or in part by the HMD device 100 in accordance with some embodiments. As depicted, the display system 200 includes the LCD panel 108 and a rendering device 202 connected via an interconnect 203. As noted above, the LCD panel 108 is implemented in a landscape orientation within the housing 102 of the HMD device 100. The rendering device 202 also may be implemented at the HMD device 100, or as a separate device connected to the HMD device 100 via the interconnect 203. The rendering device 202 includes a processor 205, a memory 207 or other non-transitory computer readable medium, and a display controller 210. The processor 205 may comprise one or more central processing units (CPUs), one or more graphics processing units (GPUs), or a combination thereof.

The display panel 108 includes a two-dimensional array 206 of liquid crystal-based pixels 208, a row controller 214, a display driver 216, a backlight 218 underlying the array 206 (although depicted to the side for ease of illustration), a backlight controller 220, and a timing controller 222. The controllers 210, 214, 216, 220, and 222 each may be implemented as hard-coded logic (e.g., an application specific integrated circuit (ASIC), programmable logic (e.g., a field programmable gate array (FPGA), or a combination thereof. The interconnect 203 may include any of a variety of interconnects utilized to connect a display panel to a corresponding device or other display sub-system, such as an interconnect based on one or more interconnects standards, such as an inter-integrated circuit (I2C)-based standard, a DisplayPort™-based standard, a high-definition multimedia interface (HDMI)-based standard, one or more proprietary interconnect configurations, or a combination thereof.

As well known in the art, each pixel 208 of the array 206 represents a corresponding color component of a corresponding pixel of the LCD panel 108 and includes a liquid crystal layer disposed between one or more polarizing layers and one or more color filter layers, as wells as circuitry to selectively generate an electric field to align the liquid crystals responsive to a pixel value buffered for the pixel 208. In some embodiments, the array 206 and the pixels 208 are configured in accordance with an In-Plane Switching (IPS) configuration, whereas in other embodiments the array 206 and the pixels 208 contained therein are configured in accordance with another LCD technology, such as a twisted nematic field effect (TN) configuration.

As a general operational overview, the display system 200 operates to generate and display a sequence of display images to a user. To this end, the memory 207 stores a software application 234 that, when executed by the processor 205 or other processor of the rendering device 202, manipulates the processor 205 to generate a sequence of display images that together represent a video sequence. This sequence of display images may comprise completely computer-rendered imagery, such as video generated to represent a user's viewpoint into a VR scene (that is, VR content), entirely captured imagery, or a combination of captured imagery and computer-rendered imagery, such as found in augmented-reality (AR) content. Each generated display image is provided to the display controller 210 in sequence, and the display controller 210 in turn transmits the pixel data of the display image in sequence to the LCD panel 108 via the interconnect 103 on a row-by-row basis.

As each row of pixel data is received at the LCD panel 108, the row is temporarily buffered in the display driver 216. The display driver 216 and row controller 214 operate together to write the pixel data buffered in the display driver 216 to the corresponding buffering elements of the pixels 208 of the corresponding row of the array 206. This process of buffering pixel data representing a display image into the corresponding buffering elements of the pixels 208 of the array 206 on a pixel row-by-row basis is referred to herein as "addressing" the pixel data of a display image. With the pixel values so stored, the circuitry of each pixel 208 of the corresponding row selectively generates an electric field responsive to the pixel value buffered for the pixel 208, and if an electric field is generated for the pixel 208, the electric field manipulates the orientation of the liquid crystals for the pixel 208 so as to selectively permit light from the backlight 218 to pass or to be blocked when the backlight 218 is activated.

The re-orientation, or "settling", of the liquid crystals of the pixel 208 in response to generation of an electric field takes a certain period of time, typically referred to as the liquid crystal's "settling time." Until the liquid crystals have been given sufficient time to settle, the liquid crystals are in an indeterminate state and thus may either permit transmission of light or block transmission of light in a manner inconsistent with the intended effect reflected by the stored pixel value. Accordingly, to ensure that the liquid crystals of all pixel rows of an LCD panel are settled before triggering the backlight 218, conventional LCD panel timing schemes require that the triggering of the backlight be delayed until at least a set duration after the last pixel row has been addressed with the corresponding row of pixel data for the image to be displayed, with this set duration being representative of the expected settling time of the liquid crystals of the LCD panel.

Figure 3:
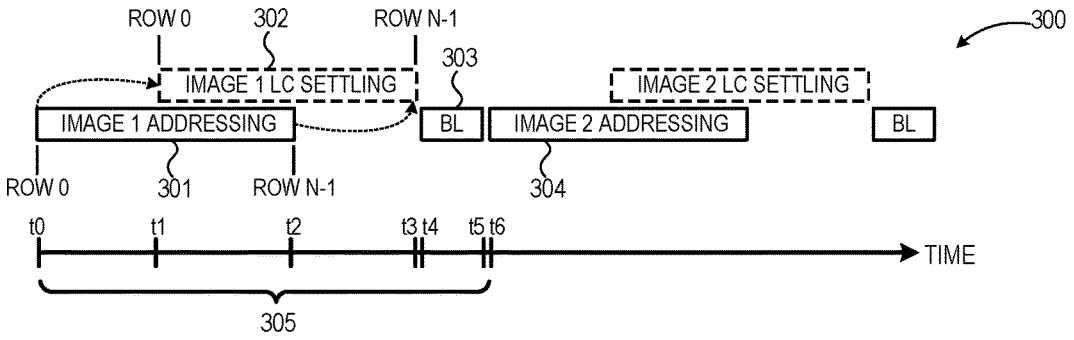
FIG. 3 is a diagram illustrating a conventional timing scheme for driving an LCD panel.

Referring briefly to FIG. 3, a timing diagram 300 depicting an example of this conventional LCD panel timing scheme is illustrated. Block 301 represents the process of addressing a first display image (image 1) into an LCD panel, with the addressing of the first pixel row (row 0) initiating at time t0 and the addressing of the last pixel row (row N-1) completing at time t2. Block 302 represents the settling time of the liquid crystals of the display panel, with the liquid crystals of the first pixel row settling at time t1 (t0<t1<t2) and the liquid crystals of the last pixel row settling at time t3 (t3>t2). Accordingly, to avoid activating the backlight before the last pixel row has settled, conventional LCD panel timing schemes require that activation of the backlight be delayed until time t4 (t4>>=t3); that is, until after the last pixel row has settled. The backlight is then activated for a duration (block 303) until time t5, whereupon addressing of the next display image (block 304) can begin at time t6 (t6>=t5). As such, the frame period 305 of this conventional LCD panel timing scheme may be represented as the duration between the initiation of addressing of the first display image at time t0 and the termination of the backlight activation at time t5.

Thus, while effective at avoiding pixel corruption at the top and bottom rows of the LCD panel, the conventional approach of delaying the backlight activation until all rows are settled results in a longer frame period, and thus a lower frame rate. However, as an LCD panel implemented in a near-eye display system, such as the HMD 100, typically is arranged in a landscape mode and is positioned close to the user's eyes, the top and bottom rows of the LCD panel are located at the lateral periphery of the user's FOV, and thus any corruption of the pixels in these rows is less likely to be detected, and thus less likely impact the user's experience. Accordingly, in at least one embodiment, the timing controller 222 of the LCD panel 108 leverages the relatively low impact of top and bottom pixel row corruption on user viewing experience in a near-eye implementation to implement a timing scheme for the display driver 216, the row controller 214, and the backlight 218 in coordination with the display controller 210, so as to overlap one or both of the backlight activation period and the addressing of the next display image with the settling period of the last one or more rows of the array 206 so as to reduce the frame period, and thus increase the frame rate. FIGS. 4-7 illustrate examples of this overlapping timing scheme in greater detail.

Figure 4:
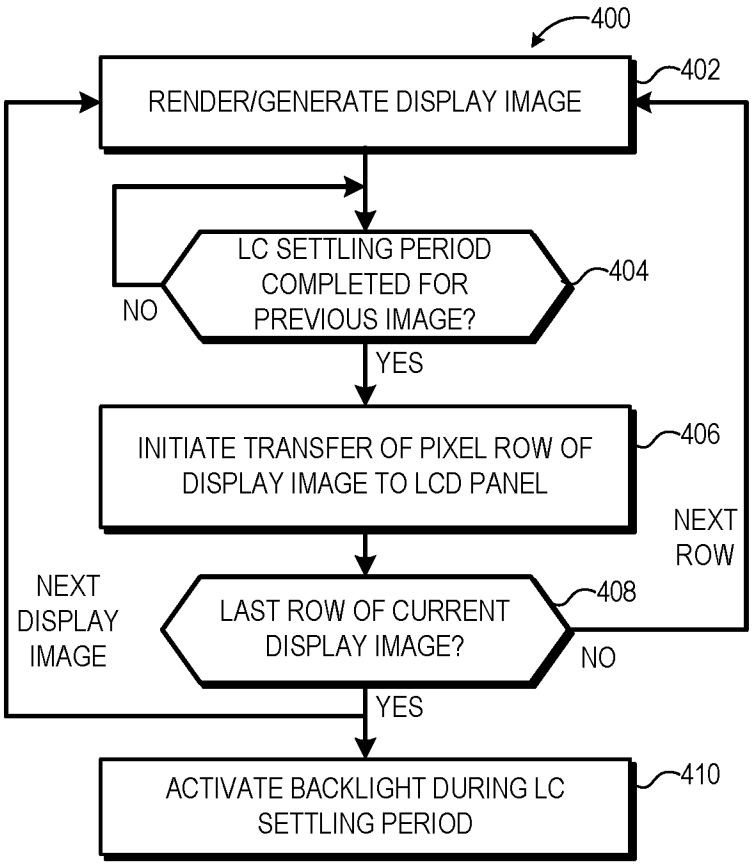
FIG. 4 is a flow diagram illustrating a method for a timing scheme for driving an LCD panel using overlapping display addressing and backlight timing in accordance with some embodiments.

FIG. 4 illustrates a method 400 representing a timing scheme that overlaps backlight activation with liquid crystal settling of the last one or more pixel rows of the LCD panel 108 in accordance with some embodiments. An iteration of method 400 initiates at block 402 with the software application 234 manipulating the processor 205 to render or otherwise generate a display image for display at the LCD panel 108, wherein the display image may be, for example, a VR display image rendered based on VR content, an AR display image generated using both real-world video content and computer-generated content, and the like. The generated display image is provided to the display controller 210 for transmission to the LCD panel 108.

If the display image is the first display image to be generated (i.e., this iteration is the first iteration of method 400), the process of block 404 is skipped. Otherwise, at block 404 the timing controller 214 coordinates with the display controller 210 to delay addressing of the current display image (that is, the transmission to, and buffering of, of pixel data for the generated display image at the array 206 of pixels 208) until a specified duration has passed since addressing for the previous display image has completed. This specified duration represents the time needed for the liquid crystals of the last pixel row to settle for the previous display image. To illustrate, assuming the liquid crystal settling time is 4.1 milliseconds (ms), then the timing controller 214 would wait until at least 4.1 ms after the last pixel row was addressed for the previous display image before signaling the display controller 210 to initiate addressing of the next display image.

After the LC settling period from addressing the previous display image has completed, at block 406 the timing controller 222 signals the display controller 210 to begin transferring pixel data for the display image generated at block 402 on a row-by-row basis to the LCD panel 108 via the interconnect 203. As each row of pixel data comes in, the pixel data is received at the display driver 216 and then the pixel value for each column is transmitted to and buffered at the corresponding row of pixels 208 as directed by signaling for the row by the row controller 214. At block 408, the timing controller 222 determines whether the most recent row addressed was the last row of the current display image. If not, the process at block 406 of addressing a row of pixel data is repeated for the next row of pixel data. Otherwise, if at block 408 the timing controller 222 determines the most recent row addressed was the last row of the current display image, flow returns to block 402 for the next iteration of method 400 for the next display image to be generated, addressed, and displayed. Further, with the addressing of the last row, the timing scheme has entered the tail end of the settling period for liquid crystals of the array 206. Accordingly, at block 410 the timing controller 222 signals the backlight controller 220 to initiate activation of the backlight 218 during the liquid crystal (LC) settling period of the last one or more pixel rows of the array 206. That is, the backlight 218 is activated even though one or more of the last pixel rows of the array 206 are still unsettled. Doing so will likely result in corruption in display of the image content contained in these one or more last pixel rows, but as noted above this corruption will occur at the periphery of the user's FOV, and comes with the benefit of reducing the frame period for displaying the display image.

Figure 5:
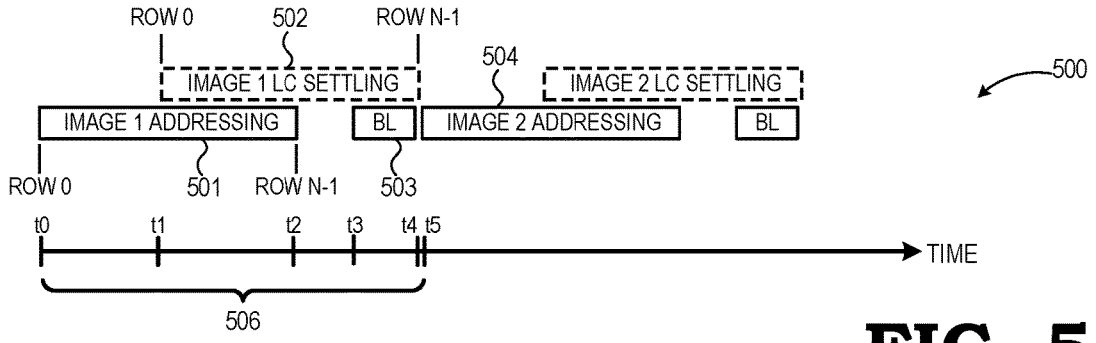
FIG. 5 is a diagram illustrating an example of the timing scheme of FIG. 4 for a sequence of display images in accordance with some embodiments.

To illustrate, FIG. 5 depicts a timing diagram 500 representing an example implementation of the method 400 of FIG. 4 for two sequential display images in accordance with at least one embodiment. At time t0, the display controller 210 initiates addressing of a first display image (image 1) by transmitting pixel data for the first display image on a sequential row-by-row basis, such that the first (top) row (row 0) is addressed at time t0 and the last (bottom) row (row N-1) is addressed at time t2, as represented by block 501. The resulting LC settling period (represented by block 502) initiates at time t1 (t1>t0) for row 0 and terminates for row N-1 at time t4 (t4>t2). The period between the end of addressing for the first display image at time t2 and the end of the LC settling time of the last pixel row N-1 at time t4 represents the window of activation and subsequent deactivation of the backlight 218 to generate a backlight pulse for displaying the first display image. Accordingly, at time t3 (t2<t3<t4), the timing controller 222 signals for activation of the backlight 218, and at some time thereafter and before or at time t4, the controller 222 signals for deactivation of the backlight 218. In the illustrated example, the backlight 218 is terminated at the same time as the end of the expected LC settling period at time t4, but in other embodiments the backlight 218 may be deactivated sooner. As such, the timing of the backlight activation/deactivation period (block 503) "overlaps" the LC settling period for one or more of the last pixel rows of the array 206, and thus the backlight activation period effectively overlaps the addressing period for the first display image.

The delay between end of addressing of the last pixel row at time t2 and the activation of the backlight 218 at time t3 may be determined based on a number of factors, including the LC settling time, the intended backlight activation duration, and the like. To illustrate, the fewest rows of the array 206 will be corrupted by the early activation of the backlight 218 by shifting the backlight activation so that the backlight activation terminates at the very end of the LC settling period. To illustrate, with an LC settling time of, for example, 4.0 ms and a specified backlight activation duration of 1.1 ms, the timing of activation of the backlight 218 can be specified to be 2.9 ms after the end of addressing of the last pixel row (that is, t3=t2+2.9 ms)

During the addressing and backlight activation periods for the first display frame, the rendering device 202 renders a second display image (image 2). At time t5 following the end of the LC settling period (t5>=t4), the timing controller 222 signals the display controller 210 to begin transmission of the pixel data for the second display image, and thus addressing (block 504) of the second display image is initiated at time t5, and the same overlapping addressing/backlighting timing scheme is employed for the second display image, and the following display image, and so on.

As illustrated by this example, the frame period 506 of a display image is represented by the time between initiation of addressing of the first pixel row of the display image at time t0 and initiation of addressing of the first pixel row of the next display image at time t5 (which is effectively time 4 for purposes of calculating frame period). Thus, assuming, for example, an 8.3 ms addressing period (i.e., t2−t0=8.3 ms) and a 4 ms LC settling period (i.e., t4−t3=4 ms), the frame period is 12.3 ms, which represents a maximum frame rate of approximately 81.3 frames per second (fps). Using these same values and a 1.1 ms backlight activation period, the frame period of a conventional timing scheme is a minimum of 13.4 ms, and thus having a maximum frame rate of only 74 fps. This increase in frame rate comes at the expense of potential corruption in the display of the pixels at the last pixel rows of the LCD panel 108. However, this corruption may be imperceptible, or nearly so, to the user as the corrupted pixel rows are at the lateral periphery of the user's FOV, and thus represents a more than fair tradeoff for the improved frame rate and reduced motion blur that may be achieved as a result.

Figure 6:
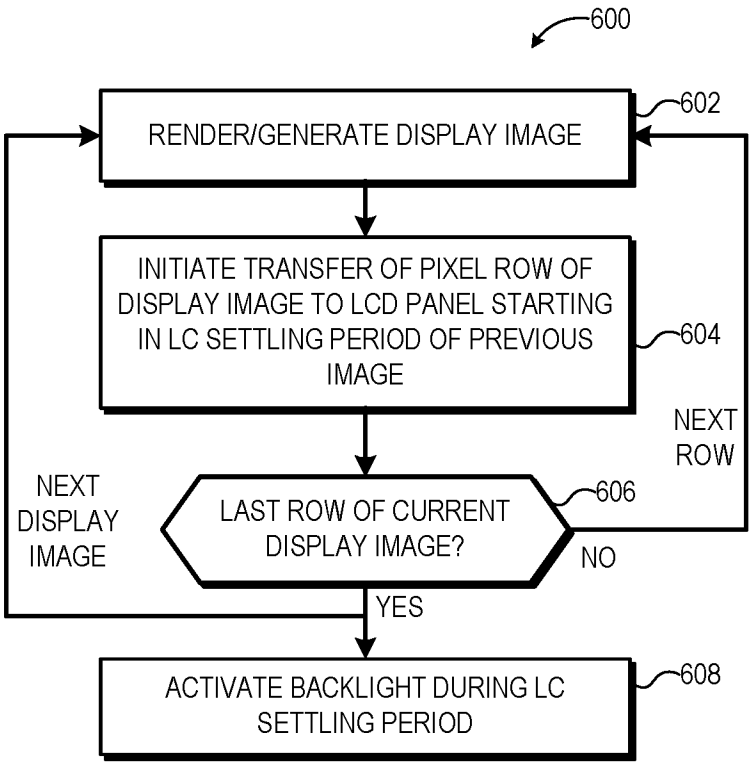
FIG. 6 is a flow diagram illustrating another method for a timing scheme for driving an LCD panel using overlapping display addressing and backlight timing in accordance with some embodiments.

FIG. 6 illustrates a method 600 representing a timing scheme that overlaps both backlight activation and an initial portion of addressing of a next display image with the liquid crystal settling of the last one or more pixel rows of the LCD panel 108 for a current display image in accordance with some embodiments. An iteration of method 600 initiates at block 602 with the processor 205 rendering or otherwise generating a display image for display at the LCD panel 108 and generated display image is provided to the display controller 210 for transmission to the LCD panel 108.

Assuming the display image generated at block 602 is not the first display image generated in the corresponding sequence of display images (that is, this is a second or subsequent iteration of method 600), at block 604 the timing controller 222 signals the display controller 210 to initiate addressing of the display image generated at block 602 to the array 206 of the LCD panel 108 during the LC settling period of the previous display image addressed to the array 206. That is, rather than waiting for the LC settling period to end for one display image before starting the addressing of the next display image as in method 400, method 600 takes a more aggressive approach of initiating addressing of the next display image while the last one or more pixel rows are still settling for the previous display image.

At block 606, the timing controller 222 determines whether the last row of the display image generated at block 602 has been addressed to the last pixel row of the array 206. If not, the method flow returns to block 604 for the next row of pixel data. Otherwise, if the last pixel row has been addressed, flow returns to block 602 for the next iteration of method 600 for the next display image to be generated, addressed, and displayed. Further, with the addressing of the last row, the timing scheme has entered the tail end of the settling period for liquid crystals of the array 206. Accordingly, at block 608 the timing controller 222 signals the backlight controller 220 to initiate activation of the backlight 218 during the liquid crystal (LC) settling period of the last one or more pixel rows of the array 206.

Figure 7:
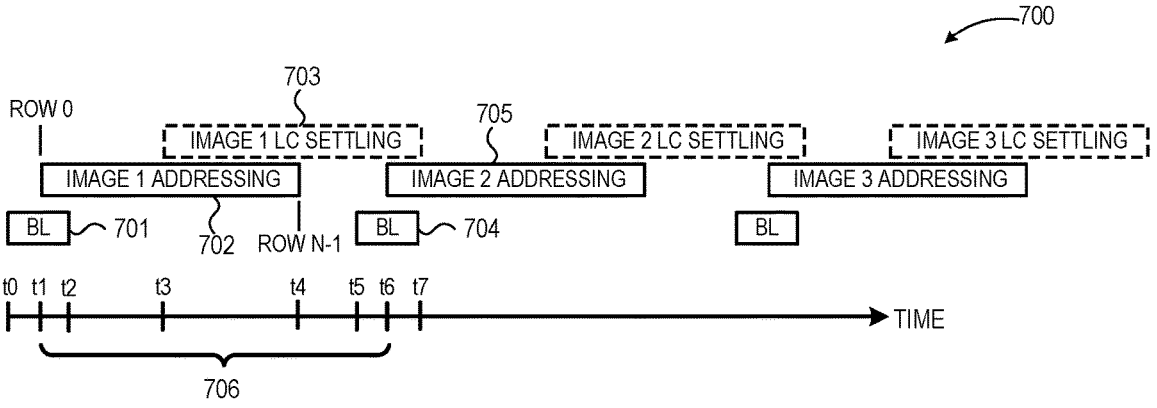
FIG. 7 is a diagram illustrating an example of the timing scheme of FIG. 6 for a sequence of display images in accordance with some embodiments.

FIG. 7 depicts a timing diagram 700 representing an example implementation of the method 600 of FIG. 6 for sequential display images in accordance with at least one embodiment. In method 600, rather than initiating a sequence of display images with addressing of the first display image, the sequence is instead initiated with a backlight activation period. Accordingly, at time t0 the timing controller 222 signals the backlight controller 220 to activate the backlight 218 and at time t2 the timing controller 222 signals the backlight controller to terminate activation of the backlight 218, thus resulting in a backlight activation period (block 701) from time t0 to time t2.

At time t1, the timing controller 222 signals the display controller 210 to initiate addressing of a first display image (image 1) by transmitting pixel data for the first display image on a sequential row-by-row basis, such that the first (top) row (row 0) is addressed at time t1 and the last (bottom) row (row N-1) is addressed at time t4, as represented by block 702. The resulting LC settling period (represented by block 703) initiates at time t3 (t3>t1) for row 0 and terminates for row N-1 at time t7 (t7>t3). The period between the end of addressing for the first display image at time t4 and the end of the LC settling time of the last pixel row N-1 at time 74 represents a window for both the activation and subsequent deactivation of the backlight 218 to generate a backlight pulse for displaying the first display image and for the initiating of addressing for the next display image. Accordingly, at time t5 (t4<t5<t7), the timing controller 222 signals for activation of the backlight 218, and at some time thereafter and before or at time t7, the controller 222 signals for deactivation of the backlight 218. In the illustrated example, the backlight 218 is terminated at the same time as the end of the expected LC settling period at time t7, but in other embodiments the backlight 218 may be deactivated sooner.

Further, the timing controller 222 signals the display controller 210 to initiate addressing (block 705) of a second display image (image 2) at a time t6 after the end of addressing of the first display image and prior to the end of the LC settling period (t4<t6<t7). As such, the timing of the backlight activation/deactivation period (block 704) "overlaps" the LC settling period (block 703) for one or more of the last pixel rows of the array 206. The limiting of the initial portion of the addressing of the next display image (block 705) likewise overlaps the LC settling period. As such, both the backlight activation period and the addressing of the next display image effectively overlaps the end of the addressing period for the first display image. This results in a shortened frame period for each display image compared to both the conventional LCD timing scheme and the overlapping timing scheme of method 400. To illustrate, the frame period 706 of a display frame in accordance with the overlapping timing scheme illustrated by FIGS. 6 and 7 can be represented as the period between the start of addressing of the first image at time t1 and the start of addressing of the second image at time t6. Thus, using the same example parameters used in the examples of FIGS. 3 and 5, with 8.3 ms needed for addressing the first display image, and assuming addressing of the second display image initiates 2.8 ms after addressing for the first display image ends (and during the LC settling period of the first display image), the total frame period 706 would be 11.1 ms, which results in a frame rate of 90 fps.

Initiation of addressing of the next display image before the LC settling period for the previous display image completes for the previous display image results in the array 206 containing pixel data for the next display image in the first one or more pixel rows and pixel data for the previous display image in the remaining pixels, the last one or more of which are still waiting for LC settling. Accordingly, the first pixel rows and last pixel rows have an indeterminate state, and thus are "corrupted," during the corresponding activation of the backlight 218 during this period. However, as noted above, the first and last pixel rows of the LCD panel 108 are at the lateral periphery of the user's FOV and thus less likely to be noticed by the user. Moreover, any such edge corruption typically would be a fair trade for the increased frame rate provided by allowing the edge corruption. Also, it will be appreciated that in the timing scheme of method 600, the edge corruption is balanced between both lateral edges, rather than being concentrated at the lateral edge corresponding to the bottom rows of the array 206, and thus is likely to be less discernible than the pixel corruption triggered by the timing scheme represented by method 400. In the event that the pixel corruption is at risk of distracting the user, in some embodiments, the lenses 112, 114 (FIG. 1) can be configured so as to occlude the edge pixel rows from the user's view or otherwise defocus the lateral peripheries of the LCD panel 108, with the trade off of a reduced FOV.

In some embodiments, certain aspects of the techniques described above may implemented by one or more processors of a processing system executing software. The software comprises one or more sets of executable instructions stored or otherwise tangibly embodied on a non-transitory computer readable storage medium. The software can include the instructions and certain data that, when executed by the one or more processors, manipulate the one or more processors to perform one or more aspects of the techniques described above. The non-transitory computer readable storage medium can include, for example, a magnetic or optical disk storage device, solid state storage devices such as Flash memory, a cache, random access memory (RAM) or other non-volatile memory device or devices, and the like. The executable instructions stored on the non-transitory computer readable storage medium may be in source code, assembly language code, object code, or other instruction format that is interpreted or otherwise executable by one or more processors.

A computer readable storage medium may include any storage medium, or combination of storage media, accessible by a computer system during use to provide instructions and/or data to the computer system. Such storage media can include, but is not limited to, optical media (e.g., compact disc (CD), digital versatile disc (DVD), Blu-Ray disc), magnetic media (e.g., floppy disc, magnetic tape, or magnetic hard drive), volatile memory (e.g., random access memory (RAM) or cache), non-volatile memory (e.g., read-only memory (ROM) or Flash memory), or microelectromechanical systems (MEMS)-based storage media. The computer readable storage medium may be embedded in the computing system (e.g., system RAM or ROM), fixedly attached to the computing system (e.g., a magnetic hard drive), removably attached to the computing system (e.g., an optical disc or Universal Serial Bus (USB)-based Flash memory), or coupled to the computer system via a wired or wireless network (e.g., network accessible storage (NAS)).

Note that not all of the activities or elements described above in the general description are required, that a portion of a specific activity or device may not be required, and that one or more further activities may be performed, or elements included, in addition to those described. Still further, the order in which activities are listed are not necessarily the order in which they are performed. Also, the concepts have been described with reference to specific embodiments. However, one of ordinary skill in the art appreciates that various modifications and changes can be made without departing from the scope of the present disclosure as set forth in the claims below. Accordingly, the specification and figures are to be regarded in an illustrative rather than a restrictive sense, and all such modifications are intended to be included within the scope of the present disclosure.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims. Moreover, the particular embodiments disclosed above are illustrative only, as the disclosed subject matter may be modified and practiced in different but equivalent manners apparent to those skilled in the art having the benefit of the teachings herein. No limitations are intended to the details of construction or design herein shown, other than as described in the claims below. It is therefore evident that the particular embodiments disclosed above may be altered or modified and all such variations are considered within the scope of the disclosed subject matter. Accordingly, the protection sought herein is as set forth in the claims below.

What is claimed is:

1. A method for displaying one or more images using a liquid crystal display (LCD) panel, the method comprising:

activating a backlight of the LCD panel;

sequentially buffering each row of pixel data of a first display image in a corresponding pixel row of the LCD panel, wherein buffering of at least one row of the pixel data occurs while the backlight of the LCD panel is activated;

reactivating the backlight of the LCD panel after a last row of pixel data of the first display image has been buffered at a last pixel row of the LCD panel but before completing liquid crystal settling of the last pixel row of the LCD panel; and occluding or defocusing peripheral pixels of the LCD panel, wherein the peripheral pixels comprise the last pixel row of the LCD panel comprising the last row of pixel data.

2. The method of claim 1, further comprising:

terminating the reactivation of the backlight; and sequentially buffering at least one row of pixel data of a second display image in a corresponding pixel row of the LCD panel after terminating the reactivation of the backlight.

3. The method of claim 2, further comprising:

providing a near-eye display device, the near-eye display device comprising the LCD panel oriented in a landscape orientation; and wherein the first display image comprises one of a virtual reality display image or an augmented reality display image.

4. The method of claim 1, further comprising:

initiating sequential buffering of each row of pixel data of a second display image in a corresponding pixel row of the LCD panel prior to completing the liquid crystal settling of the last pixel row of the LCD panel, wherein, while the backlight is reactivated, at least one pixel row of the LCD panel buffers a corresponding row of pixel data from the second display image and other pixel rows of the LCD panel settle after buffering corresponding rows of pixel data from the first display image, and wherein the peripheral pixels further comprise the at least one pixel row of the LCD panel.

5. The method of claim 4, further comprising:

providing a near-eye display device, the near-eye display device comprising the LCD panel oriented in a landscape orientation; and wherein the first and second display images comprise one of virtual reality display images or augmented reality display images.

6. The method of claim 1, further comprising:

providing a near-eye display device, the near-eye display device comprising the LCD panel oriented in a landscape orientation; and wherein the first display image comprises one of a virtual reality display image or an augmented reality display image.

7. The method of claim 6, further comprising:

generating, at a rendering device, the first display image; and sequentially transmitting each row of pixel data of the first display image from the rendering device to the LCD panel.

8. A display system comprising:

a liquid crystal display (LCD) panel comprising:

an array of pixel rows, each pixel row comprising a row of liquid crystal-based pixels;

a row controller configured to sequentially buffer each row of pixel data of a display image at a corresponding pixel row of the array of pixel rows;

a backlight underlying the array of pixel rows; and a timing controller configured to activate the backlight for display of the display image prior to buffering a first row of the pixel data of the display image and to reactivate the backlight after a last row of pixel data of the display image has been buffered at a last pixel row of the array of pixel rows but before completing liquid crystal settling of the last pixel row; and a plurality of lenses configured to occlude peripheral pixels of the LCD panel, wherein the peripheral pixels comprise the last pixel row of the LCD panel, wherein the timing controller is further configured to terminate the reactivation of the backlight, and wherein the row controller is further configured to sequentially buffer at least one row of pixel data of a next display image in a corresponding pixel row of the array of pixel rows after termination of the reactivation of the backlight.

9. The display system of claim 8, wherein:

the display system includes a near-eye display device comprising the LCD panel oriented in a landscape orientation; and wherein the display image comprises one of a virtual reality display image or an augmented reality display image.

10. The display system of claim 8, wherein:

the timing controller is configured to initiate sequential buffering of each row of pixel data of a next display image in a corresponding pixel row of the array of pixel rows prior to completing the liquid crystal settling of the last pixel row of the array of pixel rows; and the timing controller is configured to reactivate the backlight while at least one pixel row of the LCD panel settles after buffering a corresponding row of pixel data from the display image and to deactivate the backlight while at least one other pixel row of the LCD panel buffers a corresponding row of pixel data from the next display image.

11. The display system of claim 10, wherein:

the display system includes a near-eye display device comprising the LCD panel oriented in a landscape orientation; and wherein the display image and the next display image comprises one of virtual reality display images or augmented reality display images.

12. The display system of claim 8, wherein:

the display system includes a near-eye display device comprising the LCD panel oriented in a landscape orientation; and wherein the display image comprises one of a virtual reality display image or an augmented reality display image.

13. The display system of claim 12, further comprising:

a rendering device configured to render the display image and to sequentially transmit each row of pixel data of the display image from the rendering device to the LCD panel.

14. A head mounted display (HMD) device comprising:

a liquid crystal display (LCD) panel mounted in a landscape orientation, the LCD panel comprising an array of pixel rows and a backlight underlying the array of pixel rows; and a rendering device configured to generate display images and to sequentially transmit each row of pixel data of the display images to the LCD panel;

wherein the rendering device is configured to initiate buffering of at least one row of the pixel data of a previous display image while the backlight is activated;

wherein the rendering device is configured to initiate transmission of a current display image to the LCD panel prior to completing liquid crystal settling of one or more pixel rows of the array of pixel rows for the previous display image;

wherein the LCD panel is configured to reactivate the backlight to display a generated display image after a last row of pixel data of the generated display image has been buffered at a last pixel row of the array of pixel rows but prior to liquid crystal settling of the last pixel row such that the array of pixel rows contains pixel data from the current display image in at least one pixel row and contains pixel data from the previous display image in at least one pixel row while the backlight is reactivated; and a plurality of lenses configured to defocus peripheral pixels of the LCD panel, wherein the peripheral pixels comprise the last pixel row of the LCD panel.

15. The HMD device of claim 14, wherein the LCD panel is further configured to:

terminate the reactivation of the backlight; and sequentially buffer at least one row of pixel data of a next display image in a corresponding pixel row of the array of pixel rows after termination of the reactivation of the backlight.

16. The HMD device of claim 15, wherein the current display image comprises one of a virtual reality display image or an augmented reality display image.

17. The HMD device of claim 14, wherein the LCD panel is further configured to:

initiate sequential buffering of each row of pixel data of a next display image in a corresponding pixel row of the array of pixel rows prior to completing the liquid crystal settling of the last pixel row of the array of pixel rows completing; and reactivate the backlight while at least one pixel row of the LCD panel settles after buffering a corresponding row of pixel data from the current display image and to terminate the reactivation of the backlight while at least one other pixel row of the LCD panel buffers a corresponding row of pixel data from the next display image.

18. The HMD device of claim 17, wherein the display images comprise one of virtual reality display images or augmented reality display images.

19. The HMD device of claim 14, wherein the LCD panel is configured to provide a frame rate of approximately 90 frames per second with an LCD settling time of approximately 4.1 milliseconds.

* * * * *